US008656855B2

(12) United States Patent
Flood et al.

(10) Patent No.: US 8,656,855 B2
(45) Date of Patent: Feb. 25, 2014

(54) LIGHT-WEIGHT PORTABLE FOLDING BOAT

(75) Inventors: Peter M. Flood, Holly Springs, NC (US); Ralph C. Hoehn, Hanover, NH (US)

(73) Assignee: The Folding Boat Company, LLC, Holly Springs, NC (US)

( * ) Notice: Subject to any disclaimer, the term of this patent is extended or adjusted under 35 U.S.C. 154(b) by 98 days.

(21) Appl. No.: 13/332,479

(22) Filed: Dec. 21, 2011

(65) Prior Publication Data

US 2012/0160149 A1 Jun. 28, 2012

Related U.S. Application Data

(60) Provisional application No. 61/460,190, filed on Dec. 28, 2010.

(51) Int. Cl.
*B63B 35/00* (2006.01)

(52) U.S. Cl.
USPC ..... 114/347; 114/352; 114/353; 114/354

(58) Field of Classification Search
USPC ..... 114/347, 353, 354, 352
See application file for complete search history.

(56) References Cited

U.S. PATENT DOCUMENTS

| | | | | |
|---|---|---|---|---|
| 1,359,806 | A | 11/1920 | Holmstrom | |
| 1,649,311 | A | 11/1927 | Kaechele | |
| 2,994,891 | A | 8/1961 | Przybylski | |
| 4,004,307 | A * | 1/1977 | Hermann | 114/354 |
| 4,057,865 | A * | 11/1977 | Trautwein | 114/347 |
| 4,124,910 | A | 11/1978 | Raymond | |
| 4,274,170 | A * | 6/1981 | Simpson | 114/347 |
| 4,480,579 | A * | 11/1984 | Masters | 114/347 |
| 4,841,899 | A * | 6/1989 | Fleckles et al. | 114/347 |
| 5,615,634 | A * | 4/1997 | Gonda | 114/354 |
| 5,875,731 | A * | 3/1999 | Abernethy et al. | 114/354 |
| 6,367,405 | B1 * | 4/2002 | Smiley | 114/353 |
| 6,371,042 | B1 * | 4/2002 | Abernethy et al. | 114/354 |
| 7,383,787 | B2 * | 6/2008 | Flood | 114/353 |
| 7,568,444 | B2 * | 8/2009 | Espeseth et al. | 114/347 |
| 2008/0308030 | A1 | 12/2008 | Strus | |
| 2012/0160149 | A1 * | 6/2012 | Flood et al. | 114/353 |

FOREIGN PATENT DOCUMENTS

| | | |
|---|---|---|
| FR | 2572050 | 4/1986 |
| FR | 2590224 | 5/1987 |
| FR | 2756250 | 5/1998 |
| FR | 2758788 | 7/1998 |

(Continued)

OTHER PUBLICATIONS http://www.fujitacanoe.com/en/hi.htm; Fujita Canoe Co., Ltd.

(Continued)

*Primary Examiner* — Lars A Olson
*Assistant Examiner* — Jovon Hayes
(74) *Attorney, Agent, or Firm* — Ward and Smith, P.A.

(57) ABSTRACT

A folding boat includes a pair of stringer tube assemblies arranged for extending longitudinally when assembled and the stringer tubes of each pair of the assemblies connected by hinges to respective adjacent stringer tubes at the hinges. The stringer tubes assemblies are received within a waterproof skin. Frame members or butterfly frame members serve to connect to the assemblies of the stringer tubes within the skin to provide a frame for the waterproof skin. Fabric inflatable tubes are located within the skin, each having a seam for having the assembled stringer tubes assemblies nestled within when assembled in the frame.

28 Claims, 10 Drawing Sheets

(56) References Cited

FOREIGN PATENT DOCUMENTS

| | | | |
|---|---|---|---|
| JP | 51122299 | | 10/1976 |
| JP | 60018479 | | 1/1985 |
| JP | 1269691 | | 10/1989 |
| JP | 1269692 | | 10/1989 |
| JP | 1269693 | | 10/1989 |
| JP | 7205876 | | 8/1995 |
| JP | 2005335690 | | 12/2005 |
| WO | 2006-109337 | A1 | 10/2006 |

OTHER PUBLICATIONS

"Anatomy 101", The Original Folbot Folding Boat; Folbot, Inc. 2005.
Feathercraft: Construction.
Atlatl Folding Kayaks: Assembly Manual; www.atlyak.com.
Aufbauanleitung SZ2004—Pouch.
Long Haul Folding Kayaks: "Mark I. Assembly, Care and Maintenance Classic, Expedition".
Klepper Faltboote: Assembly Maintenance All Models.
Ally Canoe: Assembly Instructions.

* cited by examiner

LIGHT-WEIGHT PORTABLE FOLDING BOAT

CROSS REFERENCE TO RELATED APPLICATIONS

This Application is related and claims priority to U.S. Provisional Patent Application Ser. No. 61/460,190 for "Lightweight portable folding boat with inner rigid frame that assembles quickly and easily," filed Dec. 28, 2010, the disclosure of which is specifically incorporated in its entirety by reference herein.

FIELD OF THE INVENTION

This invention relates to a folding or collapsible boat that folds easily and quickly, and is light and portable for carrying. More specifically, the invention relates to a light, portable boat that folds easily and quickly within its own skin without requiring tools to assemble or disassemble the boat. The boat preferably folds into sections (e.g., thirds) making it compact, light and easy to carry and includes inflatable tubes integrated into the structure to enhance flotation and provide protection.

BACKGROUND OF THE INVENTION

Folding or collapsible boats are generally known and many designs have been commercially available for many years. As a general rule, most of the known prior art structures are made up of a complex arrangement of stringers and formers which are joined together with latches and clamps to form a relatively loose framework in which bow and stern halves are temporarily hinged together amidships. Typically, the two halves of the framework are disconnected and when assembled, are rigidly connected together inside a skin to form the assembled boat. Such designs of folding kayaks and boats when disassembled result in a large number of disconnected pieces and require a considerable amount of time to reassemble, and a set of tools. Moreover, the assembly requires skill and care in following instructions and it is not unusual to lose an important piece of the structure when assembled.

French patent publication number 2,572,050 discloses a dismantable small craft of the canoe/kayak type which includes a hull made up of a flexible envelope held in shape and in tension by a frame consisting of a set of securely fastened tubes which can be retracted, but not taken apart. However, such a structure also includes a complicated arrangement requiring a protected tube perpendicular to the length of the craft, including screw fastenings which require assembly and disassembly with tools to fold and/or assemble the boat.

An alternative design is disclosed in U.S. Pat. No. 4,274,170 which discloses a framework characterized by plural longitudinal members including forward and aft member portions, forward, aft, port, and starboard chines and gunwale member portions, and forward and aft longitudinal deck members. The framework includes a cockpit structure with longitudinal members releasably interconnecting the cockpit structure with the bow and stern of the boat. The structure disclosed therein effectively permits the cockpit structure to be folded along one axis, parallel to the midportion thereof so as to bring the midportions closer together so that the kayak can be folded into a framework suitable for use as a backpack frame. Notwithstanding this folding structure, a closer review of the patents such as, for example, FIGS. 4-8, shows a series of screws, wing nuts and other elements which need to be connected and disconnected resulting in a structure which is not easy to assemble or disassemble.

In a further development, U.S. Pat. No. 7,383,787 of one of the co-inventors herein discloses a folding boat which includes bow and stern members made up of a pair of tubes connectable to each other through a pin mechanism. A plurality of chines extend the length of the boat and are made up of connected tubes which can be disconnected amidships. Cockpit tubes serve to define a cockpit region, and are interconnected by hinges and by pin clips to allow folding along two axes approximating one-fourth of its assembled size.

While constituting an improvement over the prior art, applicants have now made certain improvements and designed a new and different lightweight portable folding boat having an inner rigid frame that assembles quickly and easily. More particularly, in accordance with the invention, a user can quickly and easily assemble and disassemble the boat since all components are contained within the boat's skin.

SUMMARY OF THE INVENTION

In accordance with the invention, traveling with a boat is made much easier.

The invention further allows a user to quickly and easily assemble and disassemble the boat.

The boat of the invention can be stored within a small area and allows the user to access remote areas of water with the boat.

The boat includes numerous advantages, among which is that it folds into a small package, in one example about 36 inches by about 15 inches by about 6 inches, making it very portable.

Yet still another advantage is that it is easy and quick to assemble and disassemble because all of the components are contained within the boat skin. Assembly time can be as short as about three (3) to about four (4) minutes.

In accordance with another aspect there are provided internal flotation tubes which may also act as shock absorbers so that the internal rigid frame and user are isolated from obstacles the boat could bump into in the water.

Yet still further, coaming is provided designed to wrap closely around the user or to be unzipped allowing greater access to the inside of the boat.

Even still further, multiple hinges are provided which allow the boat to be folded with the frame inside the boat skin without pinching its waterproof fabric skin. The boat is light, for example, in the range of about 11 to 14 pounds, resulting from use of lightweight and durable waterproof fabrics and high quality rigid tubing.

In accordance with another advantage of the invention, a rigid internal frame is provided which gives the user a firm surface for entering or exiting the boat and allows accessories such as fishing rods, drinks, cameras, motor holders or the like to be firmly secured to the boat. Yet still further, the internal parts can be easily removed to allow for repair. The combination of rigid and inflatable tubing allows for proper alignment and tensioning of the waterproof fabric skin around the frame and no tools are needed to assemble the boat, but an air pump, such as a portable air pump, can be used to hasten assembly.

The invention is a folding boat which preferably includes all components within a waterproof skin which can be easily assembled in a matter of minutes. The folding boat includes a pair of a plurality of stringer tubes arranged for extending longitudinally when assembled, and connected by hinges to respective adjacent stringer tubes at the hinges. A waterproof skin is provided for having the stringer tubes assembled therein as a frame. In one embodiment, bow tubes serve to connect one of the pair of stringer tubes assemblies to the other of the pair at a bow of the boat within the skin, and stern tubes serve to connect one of the pair of stringer tubes assemblies to the other of the pair at a stern of the boat within the skin. Frame members are provided for connecting to the pairs of the stringer tubes assemblies at spaced locations within the skin when assembled. Fabric inflatable tubes are provided within the skin, and each having a seam for having each one of the pair of plurality of stringer tubes nestled within the seam when assembled in the frame.

In a more specific aspect, the plurality of stringer tubes assemblies have the tubes thereof connected by hinges located so that the boat can be folded into sections, for example into thirds. Sleeves are provided at the ends of the individual stringer tubes of the assemblies for connecting and locking the stringer tubes together. A shock cord is tensioned inside the stringer tubes to maintain the sleeves line.

In a more specific aspect, frame sleeves are provided for holding the frame members, and the frame members comprise two frame members spaced from each other and received in a corresponding frame sleeve, and extend transverse across the boat spaced from each other, and shaped to facilitate shedding water from the top of the skin, for example, the frame members may be shaped to give a rounded shape at the top of the skin.

In another embodiment the invention provides a folding boat. The folding boat preferably including a pair of a plurality of stringer tubes assemblies, having individual stringer tubes, arranged for extending longitudinally when assembled, and each stringer tube of the assemblies connected by hinges to a respective adjacent stringer tube, at the hinges; a waterproof skin for having the stringer tubes assemblies assembled therein as a frame; butterfly frame members for connecting the pairs of the stringer tubes assemblies to each other when assembled; inflatable tubes for being arranged within the skin and each having a seam for having each of the pair of plurality of stringer tubes assemblies nestled within when assembled in the frame; and may further include center stems.

The butterfly frame members may be spaced apart from each other (e.g., positioned one toward the bow and one positioned toward the stern), and extend transverse across the boat. Further, the center stems may be connected to the butterfly frame members and may be deployed at the bow and stern during assembly to increase the overall boat length. The butterfly frame members may have an opening for allowing a user to pass items into the bow or stern. The butterfly frame members may function as a hinge between the pairs of the stringer tubes assemblies, allowing the pairs of the stringer tubes assemblies to fold side to side.

The butterfly members may each further include a pair of hinge sleeves that rotate around vertical stringer tube stanchions for connection to the stringer tubes. The butterfly members may each further include a vertical axle at its center, wherein the vertical axle may further include vertical axle sleeves that rotate about it, and wherein the butterfly members may further include attachment points for the center stems, wherein the attachment points may include center stem sleeves positioned at the top and bottom of the vertical axle.

These and other advantages and features that characterize the invention are set forth in the claims and annexed hereto and forming a part hereof. However, for a better understanding of the invention and of the advantages and objectives obtained through its use, reference should be made to the Drawings, and to the accompanying descriptive matter, in which there are described exemplary embodiments of the invention.

DETAILED DESCRIPTION OF THE INVENTION

In order to facilitate an understanding of the description of the invention, and for ease of reference, the following listing of parts and corresponding numbers is provided: 10—waterproof fabric skin; 15—stringer tubes; 17—tubing connectors; 20—fabric inflatable tubes; 22—inflatable tube air valves; 25—frame members; 30—frame sleeves; 35—stringer hinges; 37—hinge inner sleeves; 38—hinge outer sleeves; 40—shock cords; 45—sleeve tang; 50—sleeve bolt; 55—sleeve tang rivets; 60—inflatable tubes with stringer ties; 70—bow stern tube hinge; 75—coaming; 80—bow tubes and stern tubes; 90—butterfly frame; 100—latch pin; 105—hinge sleeves; 110—vertical stringer tube stanchion; 115—vertical axle; 120—vertical axle sleeves; 125—center stem; 130—center stem sleeves; and 135—spring pin.

Figure 1:
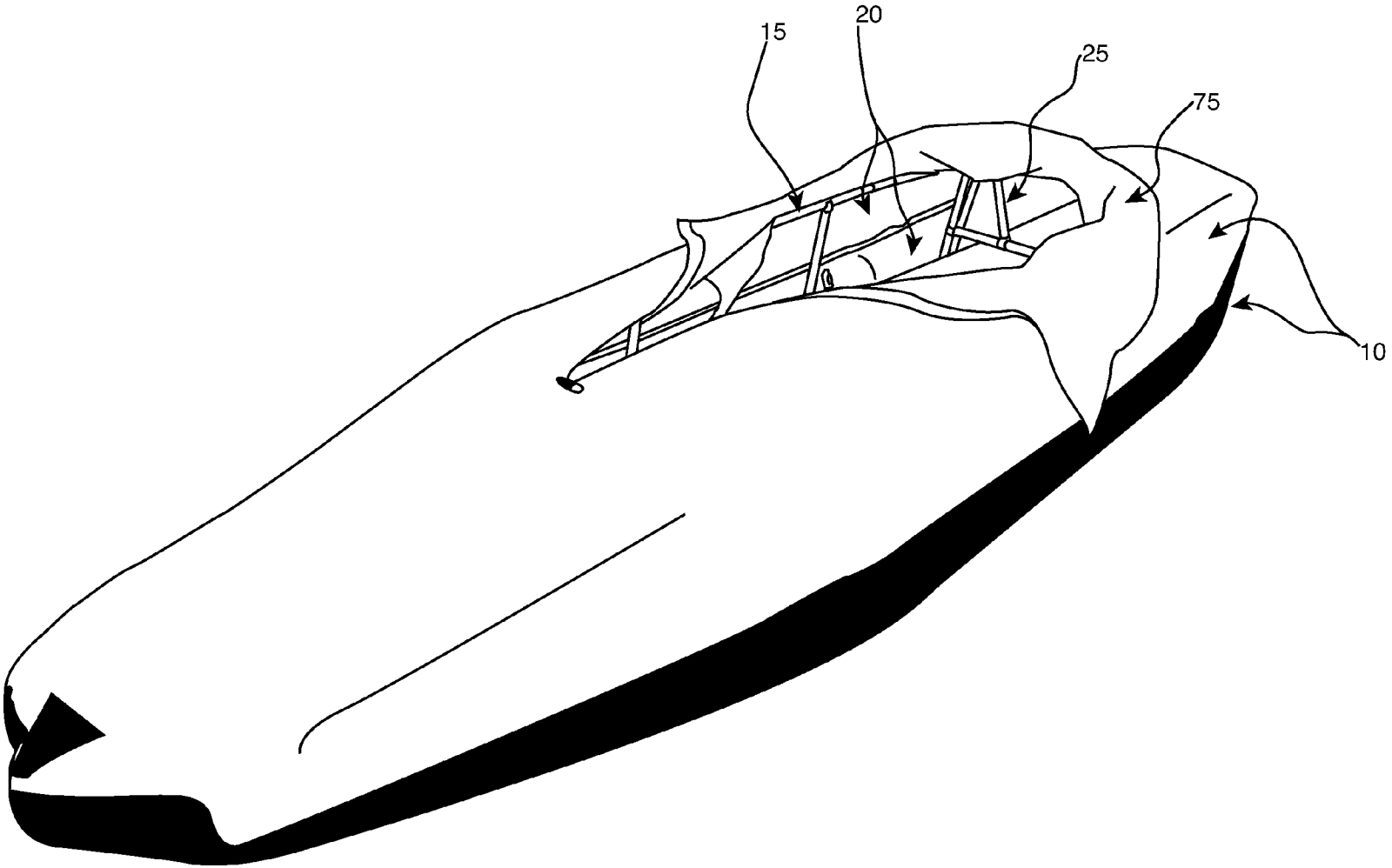
FIG. 1 is a perspective view of a fully assembled boat in accordance with the invention, providing a view through the coaming, showing in partial view internal parts thereof.
Figure 4:
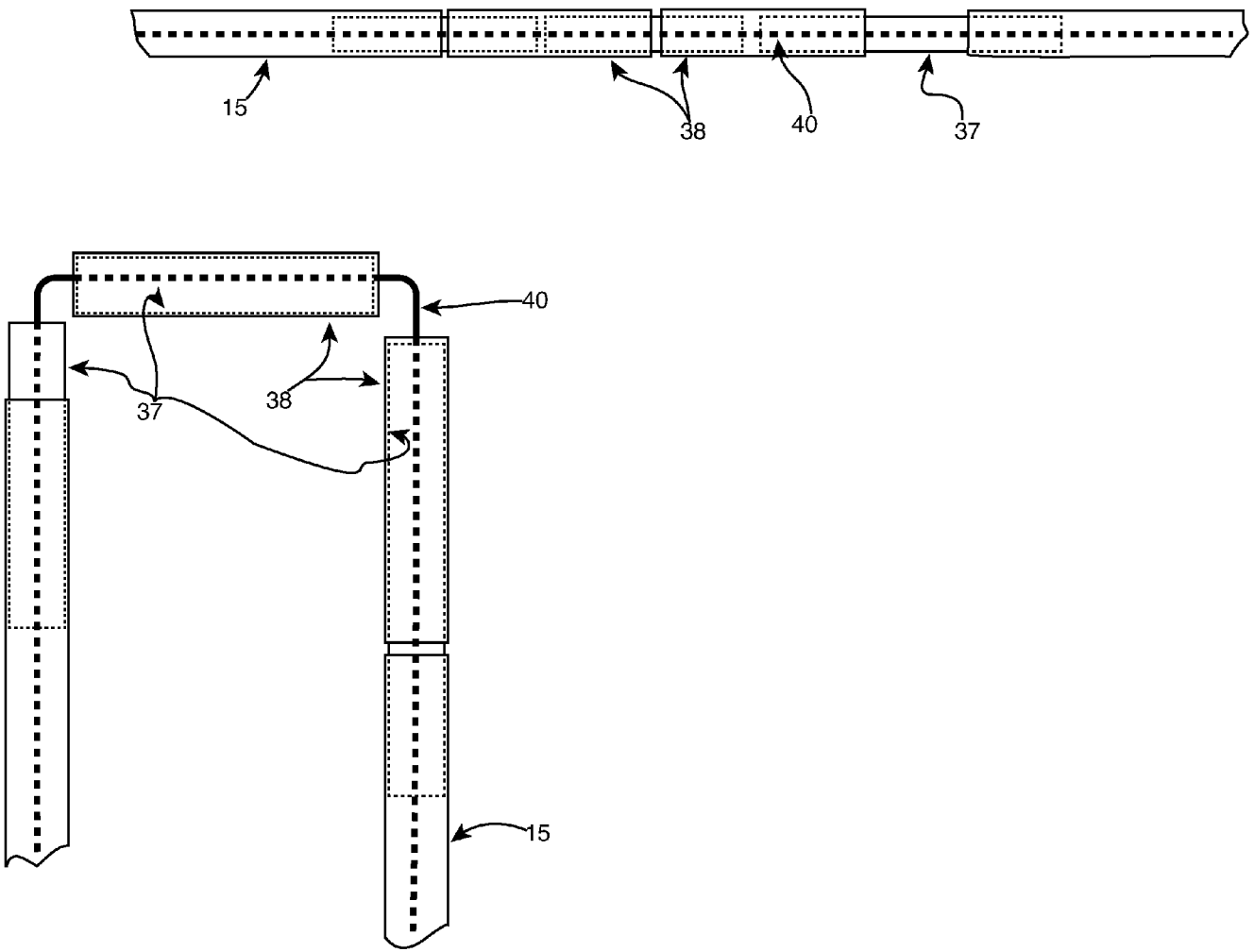
FIG. 4 are two perspective views of one set of stringer hinges showing the shock cords thereof in dashed lines within the stringer tubes, with the hinges shown in both open and closed conditions.
Figure 5:
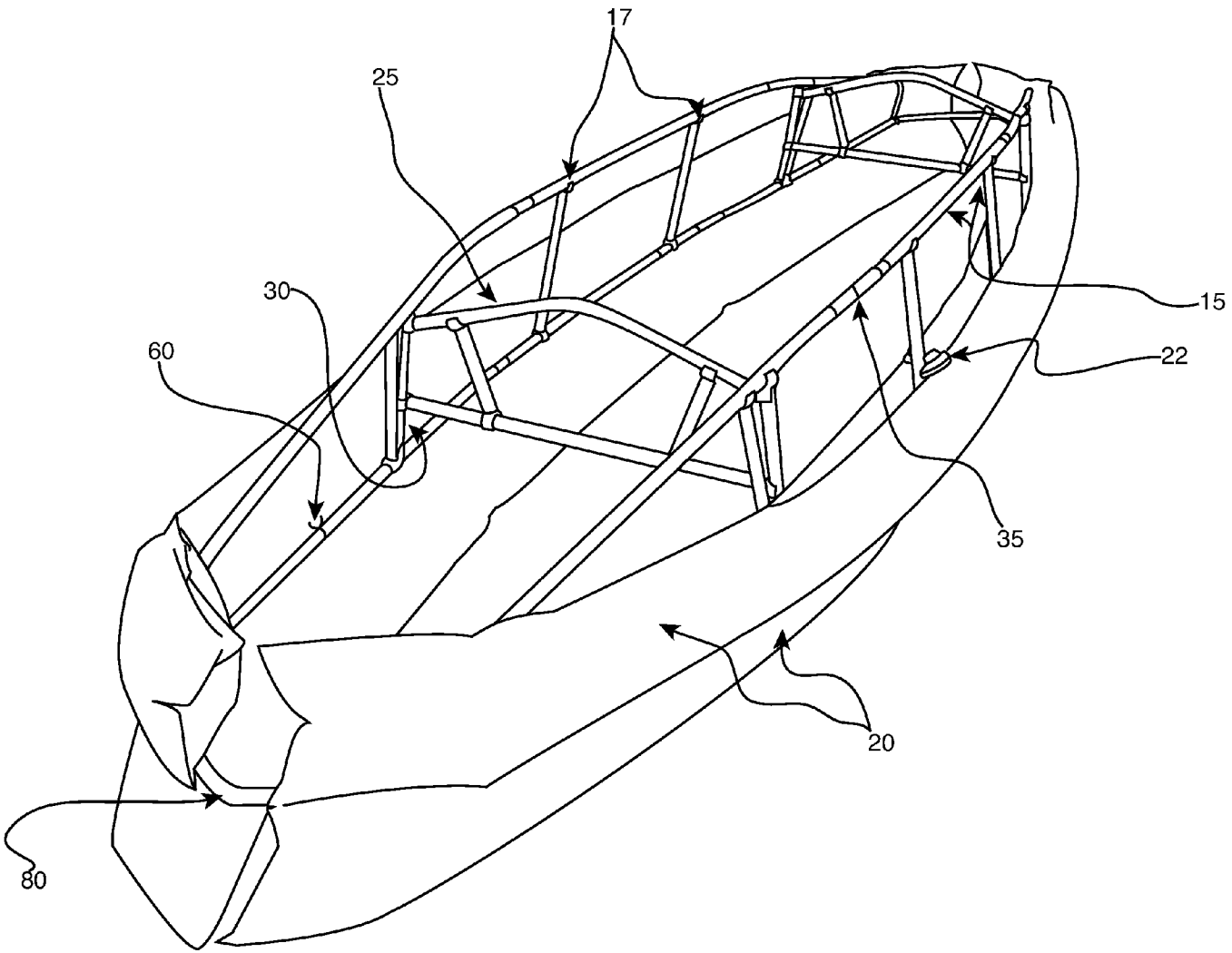
FIG. 5 is a perspective view of the stringer tubes positioned within the inflatable tubes with the waterproof fabric skin removed.

As shown in FIGS. 1, 4, 5, 6, 7, 9, and 10, the stringer tubes 15 assemblies of the invention are made up of lightweight hollow tubing such as carbon fiber, aluminum, or other suitable material. The stringer tubes 15 assemblies are assembled longitudinally within a waterproof fabric skin 10 as shown in FIGS. 1 and 5. The stringer tubes 15 and frame members 25 are connected, and are held in place by tubing connectors 17, and may also use common rivets.

Figure 2:
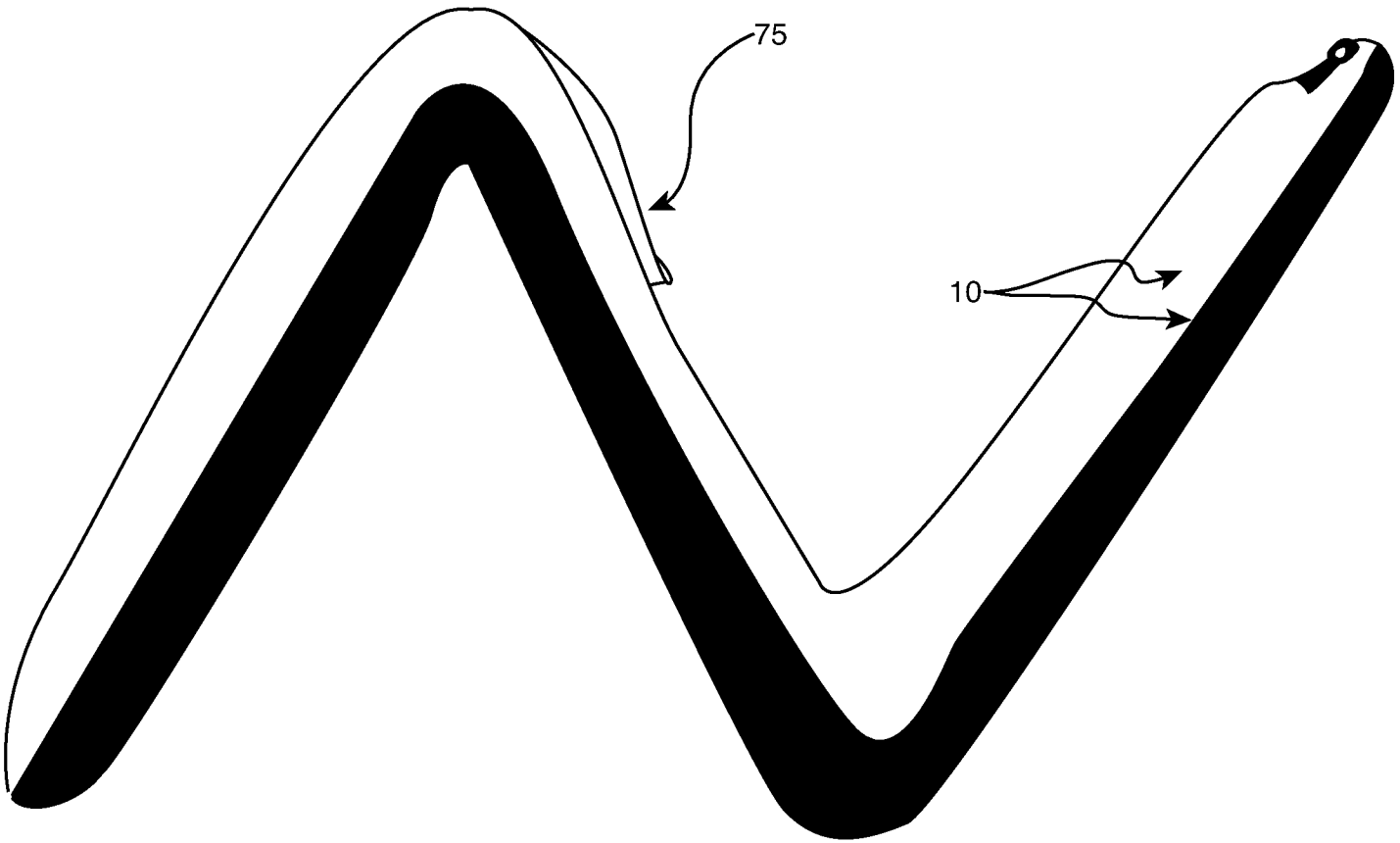
FIG. 2 is a perspective view showing the boat's folding edges.
Figure 3:
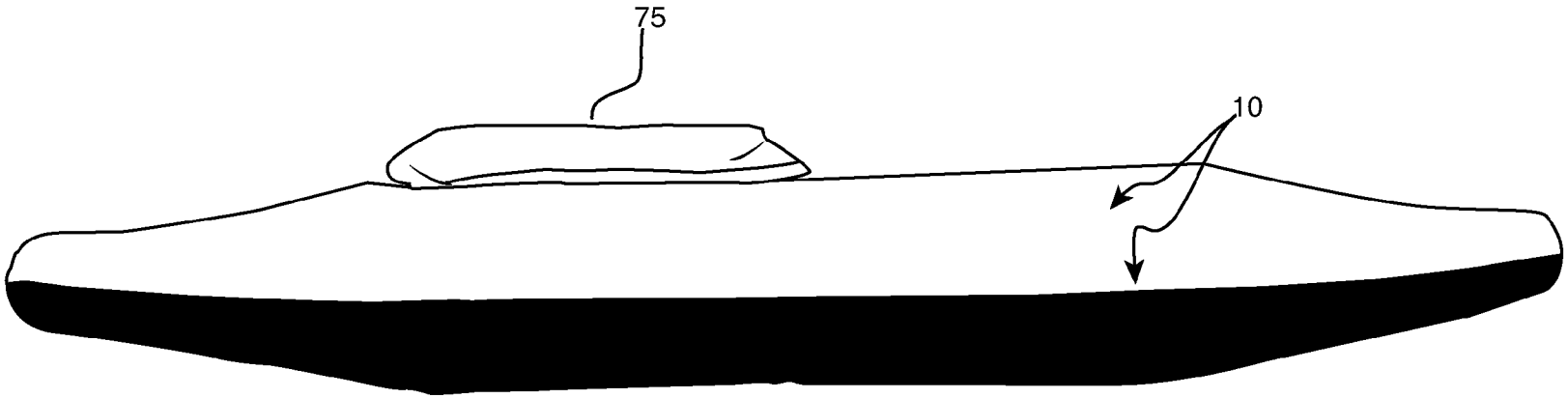
FIG. 3 is a side view of a fully assembled boat.

As shown in FIGS. 4-7, multiple hinges are employed with the stringer tubes 15 assemblies. Stringer hinges 35 provide a means for the stringer tubes 15 to fold 180 degrees without pinching the waterproof fabric skin 10. The stringer hinges 35 are located such that the boat can be folded into sections, e.g., into thirds as shown in FIG. 2. The stringer hinges 35 are made up of a hinge inner sleeve 37 and a hinge outer sleeve 38 as shown in FIG. 4. Shock cord 40 is tensioned within the individual stringer tubes 15 of the assemblies and the stringer hinges 35 to maintain the sleeves 37 and 38 aligned in place.

As shown in FIG. 4, two hinge outer sleeves 38 can be moved amidships over hinge inner sleeve 37 to allow the stringer tubes 15 assemblies bend 180 degrees. Two of the hinge inner sleeves 37 may be secured (e.g., pinned) within the stringer tubes 15 ends at each joint section. A third hinge inner sleeve 37 floats between the two hinge inner sleeves 37 that are secured utilizing shock cord 40 inside the sleeves to maintain alignment. The two hinge outer sleeves 38 can slide over the hinge inner sleeves 37.

Figure 6:
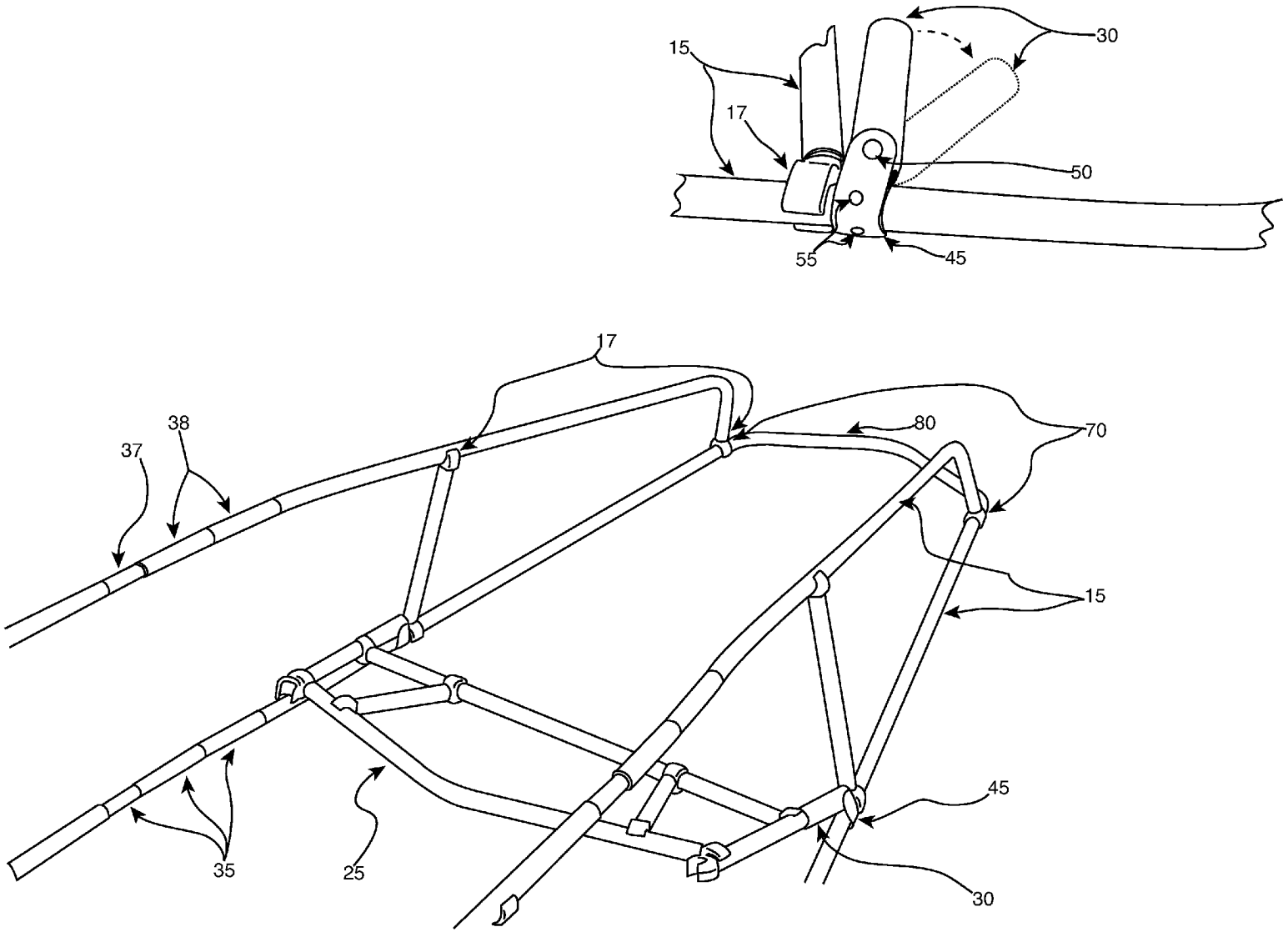
FIG. 6 is a perspective view of the frame sleeve and frame member, and a partial view of the frame member rotating into position between stringer tubes.
Figure 7:
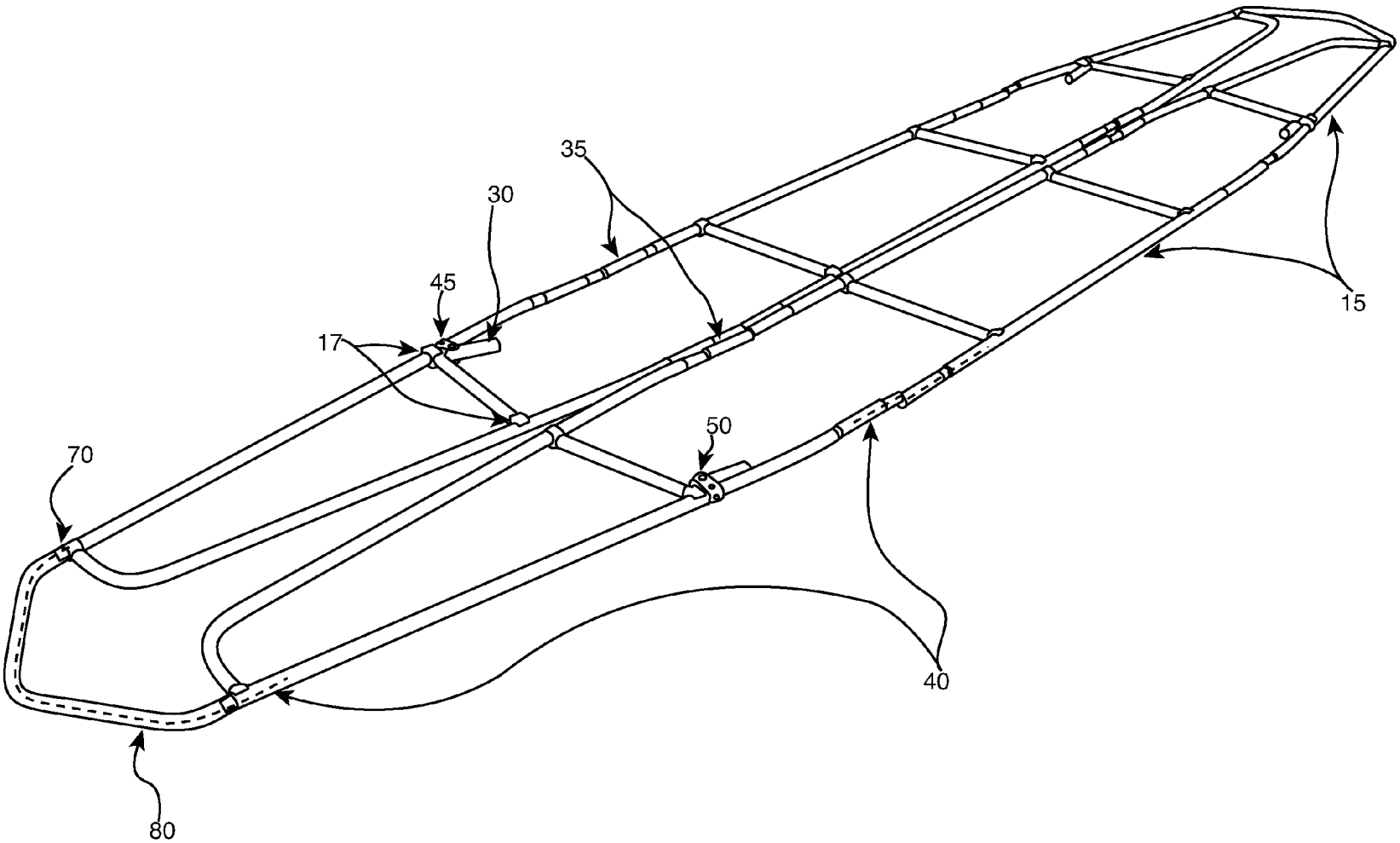
FIG. 7 is a perspective view of the stringer tubes interconnected to bow and stern tubes, and folded longitudinally.

When the hinge outer sleeves 38 are advanced away from amidships or in a locked position, the stringer tubes 15 assemblies are rigid longitudinally, as shown in FIGS. 5 and 6. Bow tubes 80 and stern tubes 80 are connected to the stringer tubes 15 through the bow stern tube hinges 70. These hinges serve to connect the two set of stringer tubes 15 together at the bow and stern of the boat. Bow stern tube hinge 70 is an inner sleeve which is secured (e.g., pinned) inside the ends of the stringer tube 15 and protrudes into the bow tube 80 and stern tube 80 ends. Shock cords 40 serves to hold the bow tube 80 and the stern tube 80 tight to the stringer tube 15 ends. In this manner, when assembled, the stringer tubes 15 assemblies are allowed to swing into a vertical position as shown in FIGS. 6 and 7.

Figure 8:
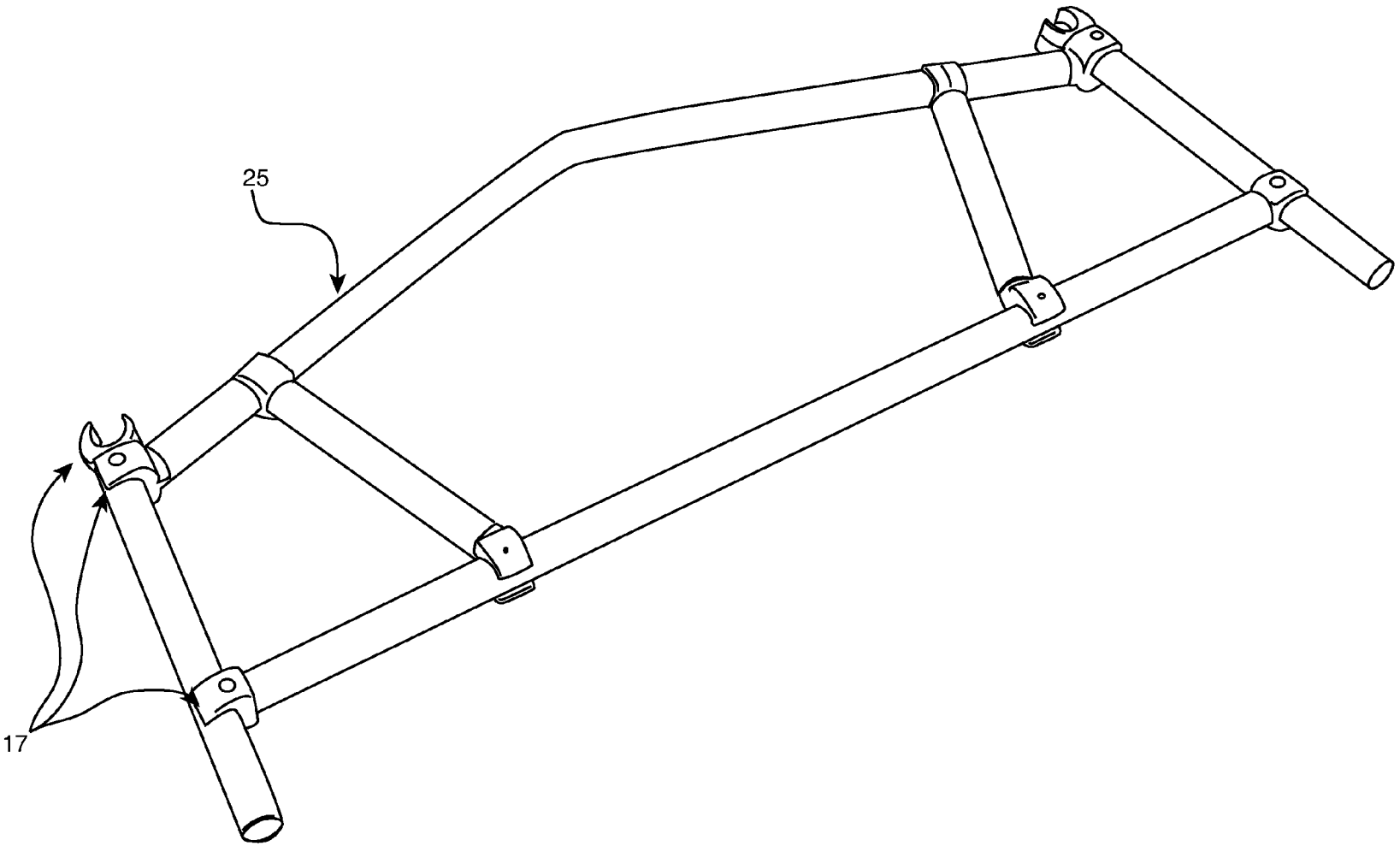
FIG. 8 is a perspective view of a frame member of the type used in the invention.

The invention may also include frame members 25, as shown in FIG. 8. Frame members 25 serve to hold the stringer tubes 15 assemblies when assembled in a nearly vertical alignment. As shown in FIG. 6, frame members 25 are inserted into frame sleeves 30. The frame sleeves 30 is attached to the sleeve tangs 45 by sleeve bolts 50, or other suitable mechanism, and is secured (e.g., pinned) to the lower section of the stringer tubes 15 assemblies with, for example, sleeve tang rivets 55, or other suitable mechanism, as more clearly shown in the partial view of FIG. 6.

When frame members 25 are inserted into the frame sleeves 30, they may be rotated into a vertical position and attached to the upper portion of the stringer tube 15 assembly through tubing connectors 17, as shown in FIG. 5. The frame members 25 are constructed to allow the user to pass or retrieve objects into the bow or stern through the center thereof. Frame members 25 may have a rounded top portion to facilitate the boat to shed water when it comes over the bow or stern, before it reaches the coaming 75.

The bottom portion of the stringer tubes 15 assemblies, when assembled, rests in a seam between the pair of fabric inflatable tubes 20 and held in place, such as by, a small diameter shock cord, ties, or other suitable means, identified as inflatable tube stringer ties 60, and at various intervals where needed to perform the required function. This is more clearly shown in FIG. 5. Each set of fabric inflatable tubes 20 are tapered proportionately to best fill out and shape the waterproof fabric skin 10 when inflated with air or other gas.

Thus, when assembled, as shown in FIG. 1, the stringer tubes 15 assemblies are nested inside the fabric inflatable tubes 20 seam, with the frame members 25 installed inside the waterproof fabric skin 10. As shown in FIG. 1, the fabric inflatable tubes 20 have been filled with air through inflatable tube air valves 22. As air is added, the waterproof fabric skin 10 is pushed outward and away from the internal stringer tubes 15 assemblies and stretched taut. A seat (not shown) may be positioned between the fabric inflatable tubes 20 in the bottom of the boat through the coaming 75.

The boat may be carried in unassembled form in a backpack (not shown). Once removed the boat may be unfolded as shown in FIG. 2 and laid flat on the ground. The user then reaches through the coaming 75 to enter the interior of the boat and slide the hinge outer sleeves 38 away from amidships over the hinge inner sleeve 37. Once all stringer hinges 35, typically numbering eight, are extended, the stringer tubes 15 are collectively assembled in a rigid form for the length of the boat. The stringer tubes 15 assemblies can now be positioned into a nearly vertical position within the waterproof fabric skin 10 and the bow tubes 80 and stern tubes 80 remain horizontal. The user then takes one frame member 25 and inserts it through the coaming 75 into the frame sleeves 30 as shown in FIG. 6. The frame member 25 is then positioned into a vertical position where it is secured in place by tubing connectors 17 to the upper portion of the stringer tubes 15 assemblies. This is accomplished preferably by stepping into the boat through the coaming 75. The other frame member 25 is installed in a similar manner.

With the internal tubing structure now in place, the inflatable tube air valves 22 are located and used to fill the fabric inflatable tubes 20 with air or other gas by means of an air pump, although it can be done by simply blowing into the tube physically with one's mouth. As air or gas enters the fabric inflatable tubes 20, the internal tubing structure assumes a rigid configuration thereby forcing the waterproof fabric skin 10 to expand and conform to a desired shape. The seat (not shown) can then be placed between the inflatable tubes inside the bottom of the boat and the boat is ready to be placed and used in the water. The inflated fabric inflatable tubes 20 serve to isolate the rigid internal tubing structure from the waterproof fabric skin 10 and protects the user and internal rigid frame from underwater obstacles such as rocks and logs, and provides for flotation should the boat capsize. Accessories may be attached to the internal tubing structure.

As may be appreciated and already discussed, the coaming 75 may be designed to allow the user to zip the closure tight to the body to keep water out or unzip to allow free access to the inside of the boat. The coaming may be part of, or attached to waterproof fabric skin 10 by any suitable methods, such as, those well known in the art.

Figure 9:
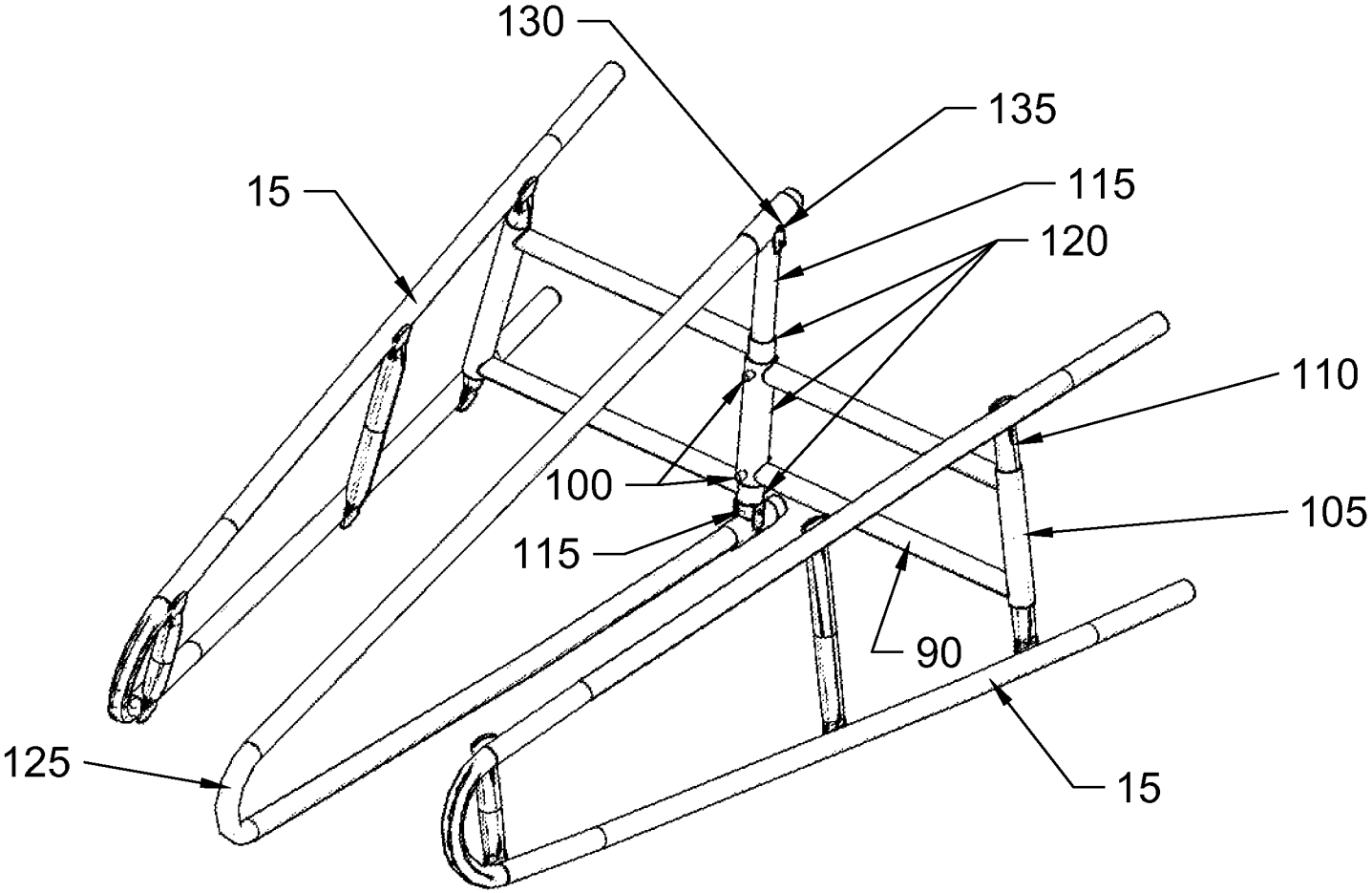
FIG. 9 is a perspective view of a butterfly frame member in an opened configuration.
Figure 10:
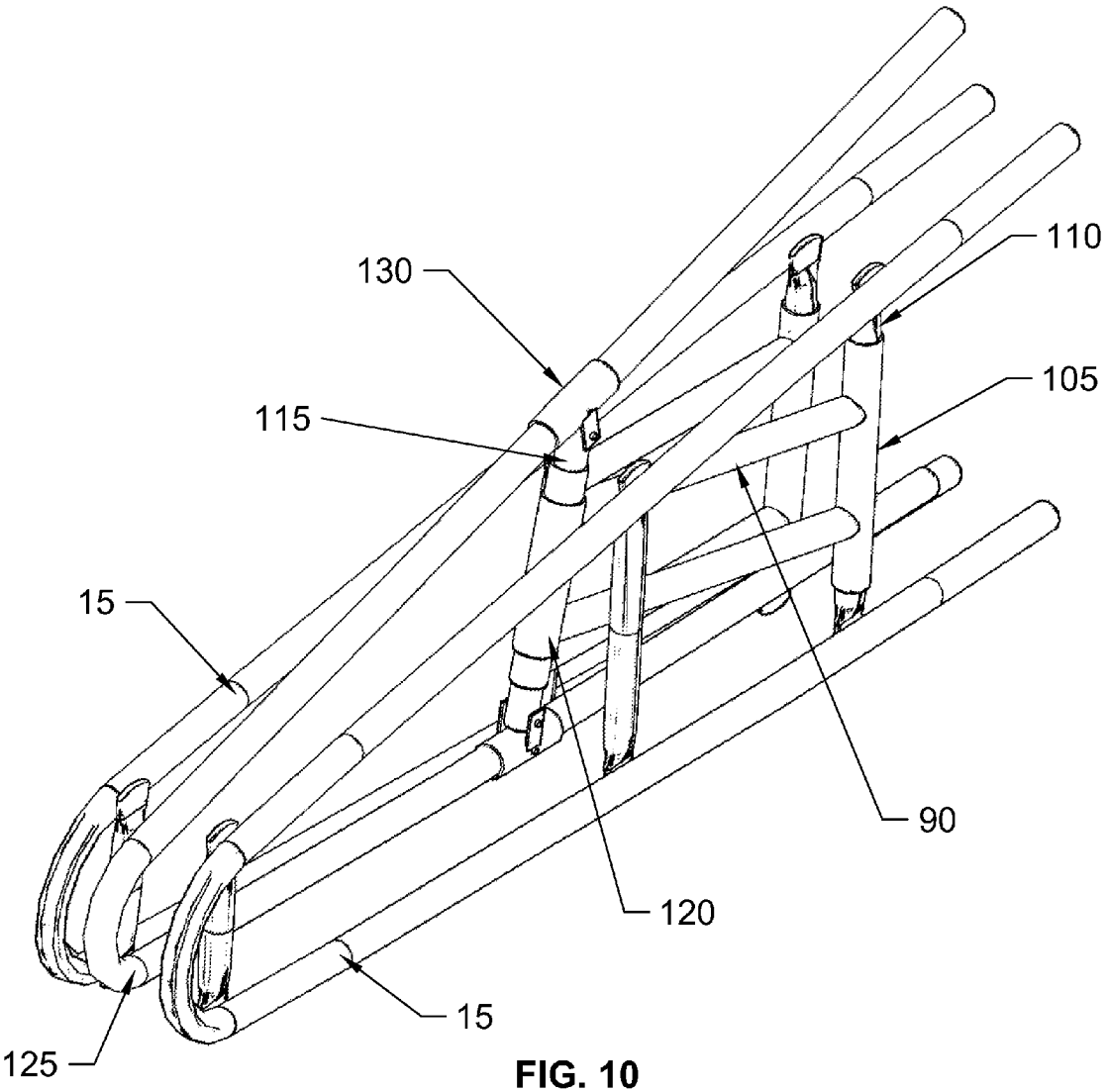
FIG. 10 is a perspective view of butterfly frame member in a closed configuration.

In another embodiment, frame members 25, and the associated connections to the stringer tubes 15, (i.e. frame sleeves 30; tubing connectors 17; sleeve tang 45; sleeve bolt 50), may be altered in shape or form to allow greater ease of installation. In one embodiment, butterfly frame members 90, as shown in FIGS. 9 and 10, may be installed inside the boat to stringer tubes 15 as an alternative to frame members 25. In one example, butterfly frames 90 may be permanently installed inside the boat to stringer tubes 15. By removing the bow stern tube hinges 70 and the bow tube 80 and stern tube 80, as shown in FIG. 6, the butterfly frame functions as a hinge between stringer tubes 15, allowing the stringer tubes 15 to fold in a side to side fashion. The butterfly frames 90 may be secured into the assembled position with a latch pin 100, for example, or other suitable securing mechanism. Butterfly frame members 90 may include a pair of hinge sleeves 105 that rotates about vertical stringer tube stanchions 110 to form a connection to the stringer tubes 15. At the center of the butterfly frame members 90 a vertical axle 115 allows vertical axle sleeves 120 to also rotate about it. The latch pin 100 is preferably installed through a hole that passes thru the vertical axle 115 and vertical axle sleeves 120 to secure the butterfly frames 90 into the assembled position and is removed for disassembly. Boat assembly time is significantly decreased with the use of the butterfly frames 90, as compared to frame members 25, as now all parts of the boat are now permanently installed inside the outer waterproof fabric skin 10.

With the butterfly frames 90 in use and the bow tube 80 and stern tube 80 removed, as shown in FIG. 9, center stems 125 may be added to the bow and/or stern with attachment points via center stem sleeves 130 to the top and bottom of the vertical axle 115. The center stem 125 in this configuration is pushed toward the bow and/or stern during deployment of the butterfly frames 90 and secured in place by, for example, spring pins 135, or other suitable type of mechanical fastener. This feature allows the boat length to be extended at the bow and stern during assembly. The center stems 125 are retracted toward amidships during disassembly while the butterfly frames 90 are being folded.

FIG. 10 shows butterfly frame 90 in a closed or folded position.

While the invention has been described in great detail, it may be appreciated that certain modifications may be made. For example, the shape of the boat may be modified to allow for greater white water performance.

Further, a greater number of internal hinges could be used to either make the boat fold into an even smaller shape, or to extend the overall length of the boat. Different materials, sizes, and interconnections can be used for all components. Slight adjustments may be made to the outer skin to allow the use of the boat to function as a rescue sled for water or snow.

While the present invention has been illustrated by a description of various embodiments and while these embodiments have been described in considerable detail, it is not the intention of the applicants to restrict, or any way limit the scope of the appended claims to such detail. The invention in its broader aspects is therefore not limited to the specific details, representative apparatus and methods, of the illustrative example shown and described. Accordingly, departures may be made from such details without departing from the spirit or scope of applicants' general inventive concept.

What is claimed is:

1. A folding boat, comprising:

a pair of stringer tubes assemblies, each of the stringer tubes assemblies having individual stringer tubes arranged for extending longitudinally when assembled;

a waterproof skin for having the stringer tubes assemblies assembled therein as a frame;

a plurality of stringer hinges connected between a plurality of adjacent stringer tubes, wherein the stringer hinges are located and configured such that the pair of stringer tubes assemblies can be folded in at least half while in the waterproof skin;

bow tubes for connecting one of the pair of stringer tubes assemblies to the other of the pair at a bow of the boat within the skin, wherein the bow tubes are connected to the pair of stringer tubes assemblies by bow tube hinges;

stern tubes for connecting one of the pair of stringer tubes assemblies to the other of the pair at a stern of the boat within the skin, wherein the stern tubes are connected to the pair of stringer tubes assemblies by stern tube hinges;

frame members for connecting the pair of stringer tubes assemblies to each other when assembled; and inflatable tubes for being arranged within the skin and each having a seam configured for having each of the pair of stringer tubes assemblies nestled within, wherein the inflatable tubes are configured to substantially isolate and properly align the stringer tubes assemblies and provide tensioning of the frame and the waterproof skin around the frame when assembled in the frame and inflated.

2. The folding boat of claim 1, wherein the stringer hinges are located and configured to connect adjacent stringer tubes such that the pair of stringer tubes assemblies can be folded in at least thirds while in the waterproof skin.

3. The folding boat of claim 1, further comprising sleeves at the ends of the stringer tubes for connecting and locking the stringer tubes together.

4. The folding boat of claim 1, further comprising frame sleeves attached to the stringer tubes assemblies for holding the frame members, and wherein the frame members comprise two frame members spaced from each other and received in a corresponding frame sleeve.

5. The folding boat of claim 1, wherein each of the fabric inflatable tubes are separate from one another and each include a separate valve for filling and emptying the fabric inflatable tubes.

6. A folding boat, comprising:

a pair of a plurality of stringer tubes assemblies, having individual stringer tubes, arranged for extending longitudinally when assembled, and each stringer tube of the assemblies connected by hinges to a respective adjacent stringer tube, at the hinges;

a waterproof skin for having the stringer tubes assemblies assembled therein as a frame;

butterfly frame members for connecting the pairs of the stringer tubes assemblies to each other when assembled; and inflatable tubes for being arranged within the skin and each having a seam for having each of the pair of plurality of stringer tubes assemblies nestled within when assembled in the frame.

7. The folding boat of claim 6, wherein the two butterfly frame members are spaced apart from each other.

8. The folding of boat claim 7, wherein the two butterfly frame members are positioned one toward the bow and one positioned toward the stern.

9. The folding boat of claim 6, wherein center stems are connected to the butterfly frame members and are deployed at the bow and/or stern during assembly to increase the overall boat length.

10. The folding boat of claim 6, wherein the plurality of stringer tubes are connected by hinges located so that the boat can be folded into thirds.

11. The folding boat of claim 6, further comprising sleeves at the ends of the stringer tubes for connecting and locking the stringer tubes together.

12. The folding boat of claim 11, further comprising a shock cord tensioned inside the stringer tubes to maintain the sleeves aligned.

13. The folding boat of claim 6, further comprising a removable seat receivable between the fabric inflatable tubes.

14. The folding boat of claim 6, wherein the butterfly frame members have an opening for allowing a user to pass items into the bow or stern.

15. The folding boat of claim 6, wherein the fabric inflatable tubes include valves for filling and emptying the fabric inflatable tubes.

16. The folding boat of claim 6, wherein the butterfly frame members are configured to function as a hinge between the pairs of the stringer tubes assemblies, allowing the pairs of the stringer tubes assemblies to fold side to side.

17. The folding boat of claim 6, wherein the butterfly members further comprise a pair of hinge sleeves that rotate about vertical stringer tube stanchions for connection to the stringer tubes.

18. The folding boat of claim 6, wherein the butterfly members further comprise a vertical axle at their center, wherein the vertical axle further comprises vertical axle sleeves that rotate about it.

19. The folding boat of claim 9, wherein the butterfly members further comprise a vertical axle at its center, wherein the vertical axle further comprises vertical axle sleeves that rotate about it, and wherein the butterfly members further comprise attachment points for the center stems, wherein the attachment points comprise center stem sleeves positioned at the top and bottom of the vertical axle.

20. The folding boat of claim 1, wherein the plurality of stringer hinges each comprise a plurality of hinge inner sleeves; and a plurality of hinge outer sleeves connected in a slidable relationship with the plurality of hinge inner sleeves, wherein the stringer hinges are configured such that when the frame is folded a gap is formed at the fold, wherein the gap is of a width such that it prevents pinching of the waterproof skin when the frame is folded.

21. The folding boat of claim 20, wherein the width of the gap at the fold is in the range of about three (3) inches.

22. The folding boat of claim 20, wherein the plurality of hinge outer sleeves can be moved amidships over the plurality of hinge inner sleeves to allow the stringer tubes assemblies to fold to in the range of about 180 degrees at the stringer hinges.

23. The folding boat of claim 20, wherein the plurality of hinge outer sleeves can be moved away from amidships over the plurality of hinge inner sleeves to allow the stringer tubes assemblies to lock in a rigid longitudinally position.

24. The folding boat of claim 1, wherein the stringer hinges each comprise three hinge inner sleeves; and two hinge outer sleeves connected in a slidable relationship with the hinge inner sleeves.

25. The folding boat of claim 24, wherein in its folded state, at each of the stringer hinges, a first end of two of the three hinge inner sleeves is each secured within ends of adjacent stringer tubes at each joint section, and the third of the three hinge inner sleeves floats between the two other hinge inner sleeves that are each additionally secured at a second end inside ends of the two hinge outer sleeves, wherein the third of the three hinge inner sleeves is substantially perpendicular to the two other hinge inner sleeves and the two other hinge inner sleeves are substantially parallel with one another.

26. The folding boat of claim 1, wherein the plurality of stringer hinges comprise sleeve hinges.

27. The folding boat of claim 1, wherein each of the stringer tubes assemblies comprising an upper portion and a lower portion, wherein the upper and lower portions are substantially parallel with one another.

28. A folding boat, comprising:

a pair of stringer tubes assemblies, each of the stringer tubes assemblies having individual stringer tubes arranged for extending longitudinally when assembled;

a waterproof skin for having the stringer tubes assemblies assembled therein as a frame;

a plurality of stringer hinges connected between a plurality of adjacent stringer tubes, wherein the stringer hinges are located and configured such that the pair of stringer tubes assemblies can be folded in at least half while in the waterproof skin;

butterfly frame members for connecting the pair of stringer tubes assemblies to each other when assembled; and inflatable tubes for being arranged within the skin and each having a seam configured for having each of the pair of stringer tubes assemblies nestled within, wherein the inflatable tubes are configured to substantially isolate and properly align the stringer tubes assemblies and provide tensioning of the waterproof skin around the frame when assembled and inflated.

* * * * *